United States Patent [19]

King

[11] Patent Number: 4,762,346

[45] Date of Patent: Aug. 9, 1988

[54] PERIPHERALLY ARRAYED CLOSURE FASTENER SYSTEM

[75] Inventor: William J. King, Wilmington, Del.

[73] Assignee: E. I. Du Pont de Nemours and Comapny, Wilmington, Del.

[21] Appl. No.: 75,777

[22] Filed: Jul. 20, 1987

[51] Int. Cl.[4] ..... E05C 9/24

[52] U.S. Cl. ..... 292/38; 292/333; 292/DIG. 38

[58] Field of Search ..... 292/38, 333, DIG. 38; 70/69, 70, 71

[56] References Cited

U.S. PATENT DOCUMENTS

| | | | |
|---|---|---|---|
| 1,674,760 | 6/1928 | Carroll | 292/333 X |
| 1,866,684 | 7/1932 | Van der Luen | 292/38 |
| 3,756,639 | 9/1973 | Wilkinson | 70/70 |
| 3,985,380 | 10/1976 | Raivio | 242/120 |
| 4,366,685 | 1/1983 | Remington | 70/70 |

*Primary Examiner*—Richard E. Moore

[57] ABSTRACT

Peripheral locking system comprising a frame enclosing an aperture and a closure for the aperture having a polymeric member extending around a portion of the perimeter of the aperture and mounted in a track, designed to lock the closure at at least two points upon movement of the polymeric member.

10 Claims, 2 Drawing Sheets

PERIPHERALLY ARRAYED CLOSURE FASTENER SYSTEM

BACKGROUND OF THE INVENTION

A wide variety of closures for doors, luggage, chests and the like have been proposed, most of which involve latching at one point. To provide the greatest measure of security combined with the strength of the material used in the structure to be closed, it would be desirable to have a peripheral closing system that locked or fastened at more than one point around the perimeter of the aperture being closed, while retaining the convenience of one operating latch. However, previous multiple peripheral closures have been complex, and unacceptable for applications such as luggage in which weight is an important consideration.

SUMMARY OF THE INVENTION

The present invention provides an effective peripheral closing system having a minimum of parts which is particularly well suited for doors, luggage and chests.

Specifically, there is provided a peripheral locking mechanism for a frame enclosing an aperture and a closure for the aperture which, in the closed configuration, provide mating surfaces on the frame and closure, the locking mechanism comprising at least two latches mounted on either the frame or the closure, hooks on the opposite mating surface positioned to engage the latches, at least one polymeric member extending between two of the latches around a portion of the perimeter of the aperture including at least one corner and mounted in a track on one of the mating surfaces, means for moving each polymeric member in its track, each polymeric member being connected to two latches in a manner such that the movement of one latch transmits force through the polymeric member to cause movement of the second latch to engage the corresponding hooks.

DETAILED DESCRIPTION OF THE INVENTION

The closing system of the present invention is applicable to a wide variety of structures, including doors, windows, luggage, chests, and the like. A central feature of this apparatus is at least two latches around the perimeter of the structure, which are connected by a polymeric member. This polymeric component can be in the form of a tape or large diameter monofilament.

Representative tapes which can be used in the present invention include those prepared from copolyetherester such as that described in Witsiepe, U.S. Pat. Nos. 3,651,014 and 3,763,109, and blends of copolyetherester and polyester such as polyethylene terephthalate and polybutylene terephthalate. Such blends are described, for example, in Brown, U.S. Pat. No. 3,907,926. Recently, large diameter polyeric monofilaments have been discovered which are also useful in the present invention, and described in Wang, copending U.S. application Ser. No. 018,385, hereby incorporated by reference.

The present invention will be more fully understood by reference to the drawings.

Figure 1:
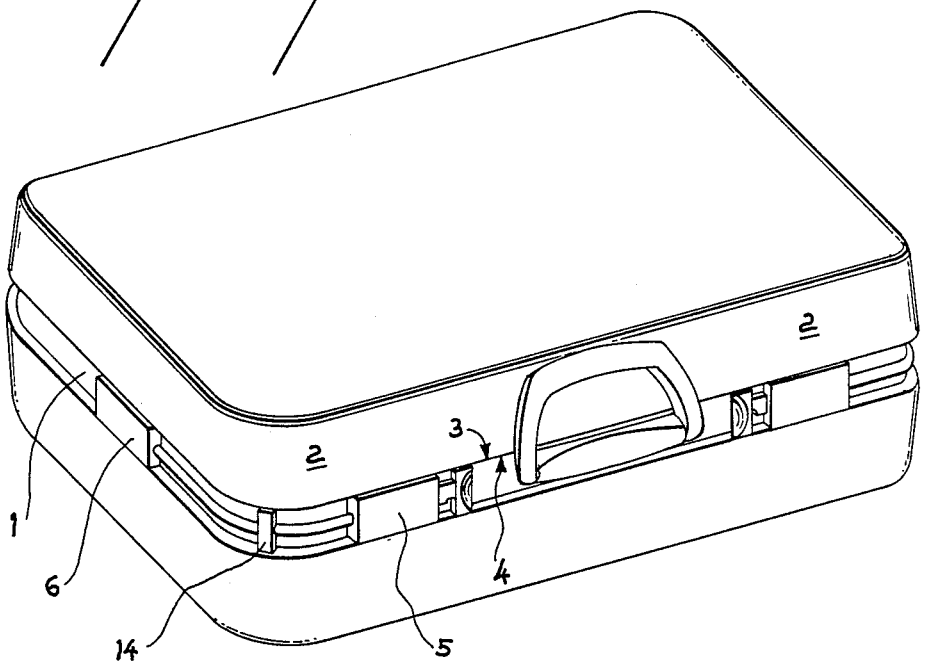
FIG. 1 is a perspective view of a closing system of the present invention.

In FIG. 1 is shown a suitcase having frame 1 enclosing an aperture and closure 2. The closure and aperture, in the closed configuration of the suitcase, provide mating surfaces 3 and 4. Latches 5 and 6 are provided around the perimeter of the suitcase, here shown mounted on frame 1, and shown in greater detail in FIGS. 2 and 3. There, hooks 7 and 8 are provided on the closure, and are adapted to be secured by the latches 5 and 6 upon lateral movement of sliding elements 9 and 10.

The latches are opened by thumb switch 11. Upon lateral movement of the thumb switch, sliding element 9 is moved to disengage hook 7. The force is transmitted by means of polymeric member 12 which is situated in track 13, also mounted on the frame, for example, by bracket 14. The track can be made of any suitable material, including, for example, a rigid polymer or metal tubing. In the event that a flat tape is used as the polymeric member, a metal track partially enclosing the polymeric member can be used.

The polymeric member, here shown as a large diameter monofilament and mounted in a sheath as a track, is abutted to the sliding element 11 in the second latch 6. The structural integrity of the monofilament permits the track and the polymeric member to be situated around corner 15 without bending or kinking in the course of operation. By contrast, steel cable, in similar applications, does not perform well under compression. In addition, the apparatus of the present invention requires no elaborate attachment for the polymeric member outside of simple abutment of the polymeric member in recesses 15 and 16 in the latch mechanism. While the depth of the recesses will necessarily vary with the size of the polymeric member and the overall design of the latch, for a polymeric member having a substantially round configuration, a recess of about ⅛ inch has been found to be satisfactory.

Figure 2:
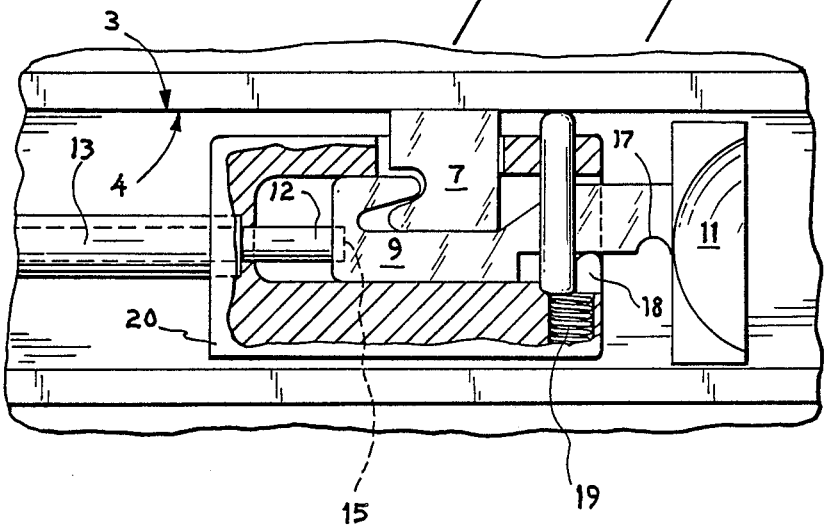
FIG. 2 is a plan view of a preferred proximal latch which can be used in the present invention.
Figure 3:
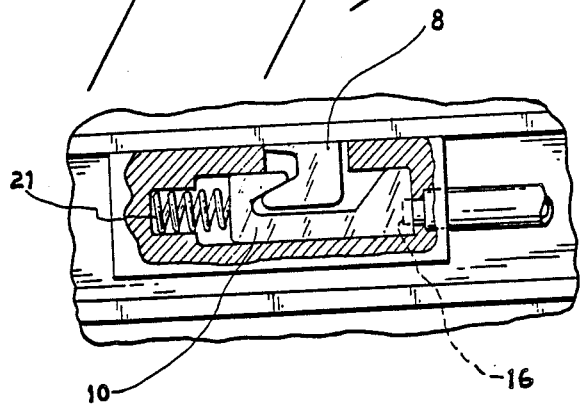
FIG. 3 is a plan view of a preferred distal latch that can be used in the present invention.

The preferred latch shown in FIG. 2 permits automatic locking of the case on closure. In that Figure, the sliding element is provided with detent 17. On lateral movement of the sliding element by means of the thumb switch, the detent permits the upward movement of tooth 18, which is loaded by spring 19. The spring is conveniently stressed between the tooth and latch housing 20. The lateral movement of the sliding element is transmitted through the polymeric member to the distal latch 6, shown in FIG. 3. In that latch, the sliding element 10 simultaneously disengages hook 8 and compresses lateral spring 21.

In the operation of the latch, the opening of the latch causes the setting of the tooth in the detent, preventing the lateral spring from closing the latches. Closing of the case forces the tooth downward, permitting the lateral spring to force the sliding elements to engage the hooks with which they are associated.

Figure 4:
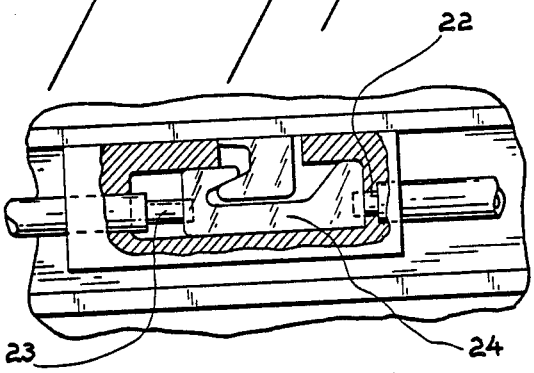
FIG. 4 is a plan view of a middle latch that can be used in the present invention.

In the event that three or more latches are desired for joint operation, they can be arranged with or without separate spring mechanisms in each latch. Without separate springs, as shown in FIG. 4, the polymeric members 22 and 23, at each end of the intermediate sliding element 24, force the latch in either direction. On actuation by the latch by the thumb switch on opening, the force is transmitted through polymeric member 22 to release the hook. When the tooth in the first latch is released from the detent by closing the case, the force from the spring in the distal latch is transmitted through polymeric member 23, engaging the hook. In the event that separate springs are used in each latch, the springs are mounted in the end of the sliding element that is distal from the first latch, with the polymeric member running through the center of the spring.

Figure 5:
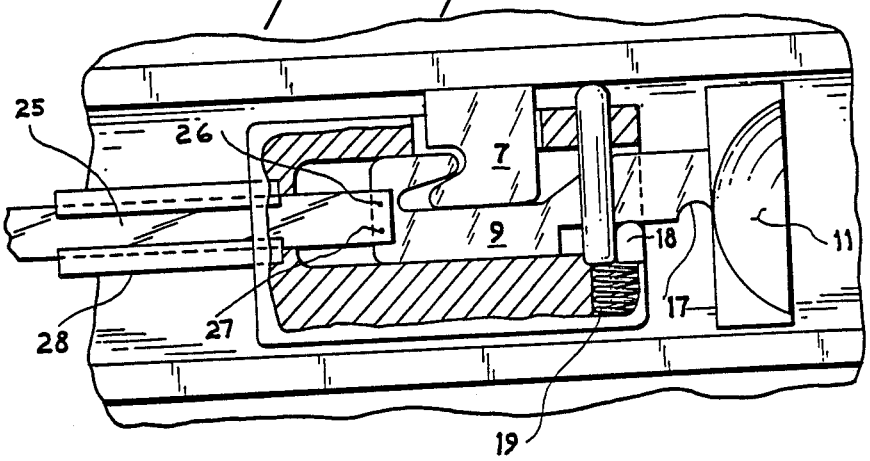
FIG. 5 is a plan view of a preferred proximal latch of the present invention using a flat tape as the polymeric member.

In the event that a tape is used as the polymeric member, a latch configuration can be used as shown in FIG. 5. There, a proximal latch has polymeric tape 25 which is attached to the sliding element by means of fasteners 26 and 27. The tape is mounted in track 28.

The track used for the polymeric member will necessarily conform to the configuration of the polymeric member. In general, for polymeric cable, a track surrounding the cable having a clearance of about from 0.050 to 0.100 inch, and preferably about 65/1000 inch, has been found to be satisfactory. The polymeric member can also be lubricated in the track, if desired. However, particularly with a metal track for the polymeric member, lubrication is generally not necessary for satisfactory operation.

I claim:

1. A peripheral locking mechanism in combination with a frame enclosing an aperture and a closure for the aperture which, in the closed configuration, provide mating surfaces on the frame and closure, the locking mechanism comprising at least two latches mounted on either the frame or the closure, hooks on the opposite mating surface positioned to engage the latches, at least one polymeric member extending between two of the latches around a portion of the perimeter of the aperture including at least one corner thereof and mounted in a track on one of the mating surfaces, means for moving each polymeric member in its track, each polymeric member being connected to two latches in a manner such that the movement of one latch transmits force through the polymeric member to cause movement of the second latch to engage the corresponding hooks.

2. A peripheral locking mechanism of claim 1 wherein the track and polymeric member are mounted on the frame.

3. A peripheral locking mechanism of claim 1 wherein the polymeric member is in the form of a tape.

4. A peripheral locking mechanism of claim 1 wherein the polymeric member is in the form of a monofilament and is abuttedly connected to the latches.

5. A peripheral locking mechanism of claim 4 wherein the polymeric member consists essentially of copolyetherester.

6. A peripheral locking mechanism of claim 4 wherein the polymeric member consists essentially of a blend of copolyetherester and polyester.

7. A peripheral locking mechanism of claim 4 wherein the polyester is polyethylene terephthalate.

8. A peripheral locking mechanism of claim 1 wherein the aperture is the top of a container and the closure is a lid for the container.

9. A peripheral locking mechanism of claim 1 wherein the aperture is a door frame and the closure is a door.

10. A peripheral locking mechanism of claim 1 wherein the latches comprise a first, proximal latch and a second, distal latch, and wherein the proximal latch includes a laterally sliding element having a detent formed therein, a first spring stressed against a tooth positioned to engage with the detent upon lateral movement of the sliding element to retain the sliding element at a distal position and to project between the mating surfaces of the closure and frame, a second spring stressed against the distal end of the most distal polymeric member such that upon mating the surfaces, the tooth will be depressed against the first spring and disengage from the detent, permitting the second spring to move the polymeric member proximally, engaging the hooks on the sliding elements.

* * * * *